US006761602B1

(12) United States Patent
Quinn

(10) Patent No.: US 6,761,602 B1
(45) Date of Patent: Jul. 13, 2004

(54) HYDROPLANE BOARD AND A METHOD OF PERSONAL HYDROPLANING

(76) Inventor: Charles Benedict Quinn, 1031 Stonehenge Dr., Hanahan, SC (US) 29406

( * ) Notice: Subject to any disclaimer, the term of this patent is extended or adjusted under 35 U.S.C. 154(b) by 0 days.

(21) Appl. No.: 10/340,888

(22) Filed: Jan. 13, 2003

(51) Int. Cl.[7] ..... B63B 1/00
(52) U.S. Cl. ..... 441/67
(58) Field of Search ..... 441/65, 67, 74

(56) References Cited

U.S. PATENT DOCUMENTS 1,872,230 A * 8/1932 Blake ..... 441/74
3,045,264 A * 7/1962 Smith ..... 441/67
3,716,880 A * 2/1973 Sorenson ..... 441/67
D256,604 S * 8/1980 Arzoian ..... D21/807
4,463,954 A * 8/1984 Panse et al. ..... 473/588
4,850,914 A * 7/1989 Cox ..... 441/65

* cited by examiner

*Primary Examiner*—Stephen Avila
(74) *Attorney, Agent, or Firm*—Kathleen M. Harleston; Harleston Law Firm LLC

(57) ABSTRACT

A hydroplane board member which is placed in very shallow water and launched by the user with a shove of their foot. The user walks, jogs, or runs and jumps onto the moving board inducing hydroplaning. The user may jump off, simultaneously accelerating a slowing board, and then jump back on, thus indefinitely extending the hydroplane action.

19 Claims, 1 Drawing Sheet

HYDROPLANE BOARD AND A METHOD OF PERSONAL HYDROPLANING

REFERENCE TO COMPACT DISK APPENDIX

Not Applicable.

BACKGROUND OF THE INVENTION

The present invention relates to a hydroplane board and a method of personal hydroplaning.

Traditional forms of hydroplane boards, also know as skimboards, involve spin-offs of surfboards. These boards have defined forward ends, sides and tails. Some are optimized for sliding down steep beach slopes with the outgoing tide and then transitioning into shore break wave riding or tricks. These wave riders have relatively thick rails and greater floatation ability suitable for maintaining buoyancy with the user in deeper water, and for maneuvering (surfing) on the small waves at the shore.

Other styles, also with defined forward ends, sides and tails, have very thin side rails. However, these boards are really cheap copies of the traditional boards discussed above, and do not perform well at either skimming or surfing.

Both kinds of boards require the user to throw the board, keeping the correct orientation, and jump onto the board before friction causes it to detour from the selected course or slew out of the desired orientation. At the conclusion of each attempt to ride, the user must pick up the board, re-orient, and start over.

This results in a very difficult sport for novices. It is very hard to maintain orientation of the board on the throw, and very difficult to mount the board before it changes orientation after the throw. Timing, balance, and maneuvering on the board are made difficult by the steep nature of the beach, if using the shore break models. Throws down steep beaches become all or nothing attempts with contusions, minor and severe, the consequences of an error.

Timing, balance, and maneuvering are made difficult by the narrow nature of rails if using the skinny models. The defined forward end and tails require the user to be proficient in order to be able to hydroplane on one of these boards. One throw, whether a ride is achieved or not and the user must pick up the board and return to start over. All of this make the existing experience less than satisfying for all but the expert, and make it difficult and time consuming to become an expert at hydroplaning.

BRIEF SUMMARY OF THE INVENTION

It is the object of the present invention to provide a new hydroplane board and a new method of hydroplaning.

More particularly, it is the object of the present invention to contribute to the sport of hydroplaning (skim boarding) by providing a device that offers optimal efficiency in terms of overall performance, safety of use, ease of use especially for novices, and radically extends the length and quality of a given hydroplane ride. The present invention is not a shore break surfboard and is unsuitable for this use.

The present invention comprises a circular board with slightly positive buoyancy. The bottom side of the board has a very low co-efficient of friction, and the top of the board is treated to have a high coefficient of friction. The rails of the circular board are approximately ⅝–3/4 inch thick and are smoothly curved from the smaller diameter bottom side to the larger diameter top side. The center of the topside is clearly marked as a reference for the user.

Hydroplaning with the present invention is naturally induced by the momentum and weight of the user onto the moving, but only slightly buoyant board. Efficiency is provided by the curvature of the rails which minimize forward friction especially during the initial contact of the user with the board. Efficiency is further enhanced by the round rails which reduce friction and allow continued forward motion even if some amount of stewing or radial motion is also present When the hydroplane board is designed and a method of hydroplaning is performed in accordance with the present invention, the user starts the board from within shallow water with a push of their foot In addition, the user can hold the board in a given starting position against the force of current and tide by spinning it in place until optimal hydroplane conditions are obtained. This enables the user to exert much less effort in the course of using the board in comparison to having to pick it up, return to a start location , throw it and then jump on it.

When the hydroplane board is designed and a method of hydroplaning is performed in accordance with the present invention, the present invention permits the user to extend indefinitely the length of the hydroplane ride by repeatedly jumping off and back on. By jumping off the present invention may be accelerated and the user may then remount the board. The circular nature of the board is unique to this invention and is a key feature which permits this mew method of hydroplaning.

When the hydroplane board is designed and a method of hydroplaning is performed in accordance with the present invention, the present invention is simple to learn and easy to master, and relatively safe to use. The circular nature of the board, along with the sloping rails from the smaller bottom side to the large top side make this board inherently stable for the hydroplane action. A novice user simply starts off with slower and shorter rides. However, all or nothing attempts at mounting are not required in order to achieve a good ride. Even if radial forces are added during a ride, a novice user may continue to hydroplane without expecting immediate, negative consequences. If deep water or waves are encountered, the board slows and sinks, without any accompanying radical change in motion. An experienced user can obtain significant speeds and lengthy hydroplane rides.

When the hydroplane board is designed and a method of hydroplaning is performed in accordance with the present invention, the present invention is simple to learn and easy to master, and relatively safe to use. Varying the overall diameter of the board, without changing the specific design details identified herein, make the present invention suitable to a wide range of users of all heights and weights and expertise.

The user enters the shallow water of the ocean or a lake. Ideally, the water should be less than ½ inch deep with an even bottom underneath. The board is placed in the water and floated. If necessary, the board can be spun round with the foot to hold it in position against the forces of tide and current while optimal conditions are obtained.

When optimal conditions are obtained, the user pushes the invention with their foot in the desired direction. The user follows behind and jumps onto the hydroplane board, exerting their forward momentum and downward mass simultaneously onto the board The center mark of the board is used as a focal point for the user such that the center of mass of the user is located slightly to the rear of this reference point, in a direct line with the desired direction of travel. Hydroplaning is immediately induced, normally at a speed much greater than the prior speed of either the board or the user prior to the user mounting the board When the board slows, or as desired by the user, the user may jump off of the board, simultaneously accelerating it in the direction opposite the dismount. The user may then follow behind and jump back onto the hydroplane board In this fashion, an experienced user may indefinitely extend the length of their ride.

If deeper water or waves are encountered, the board will naturally slow and sink. Alternatively, the user may stop and dismount the board at any time by simply moving their center of mass backwards or forwards on the board and causing the leading or trailing edge to dig in.

BRIEF DESCRIPTION OF THE DRAWINGS

The inventions itself, both as to its construction and its method of operation, together with additional objects and advantages thereof, will be best understood from the following description of specific embodiments when read in connection with the accompanying drawings.

DETAILED DESCRIPTION OF THE INVENTION

Figure 1:
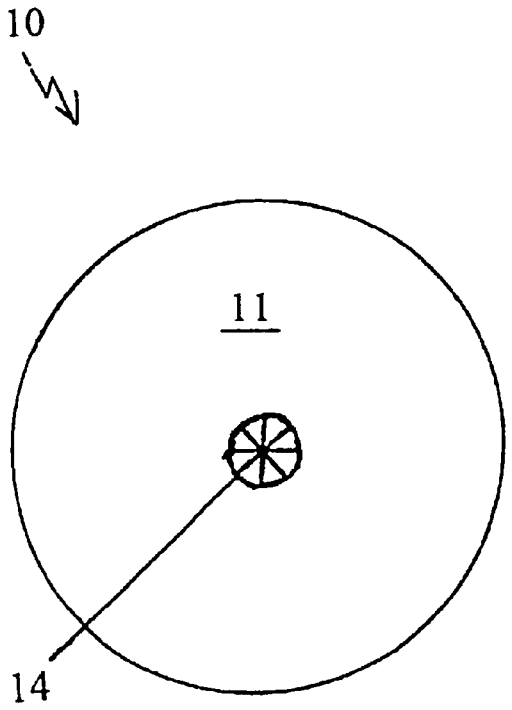
FIG. 1 shows a top plan view of the present invention. The diameter should be adjusted between 24 and 40 inches, to be optimal for the given user.
Figure 2:
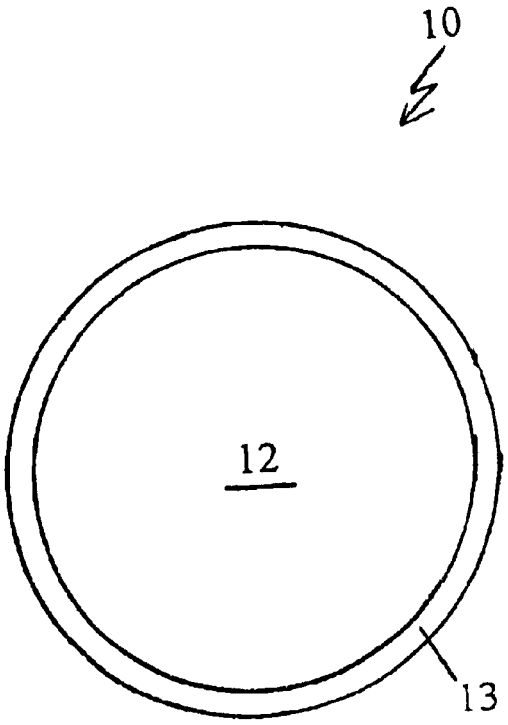
FIG. 2 shows a bottom plan view of the present invention. The flat portion of the bottom side is approximately 2 inches in diameter less than the top side diameter.
Figure 3:
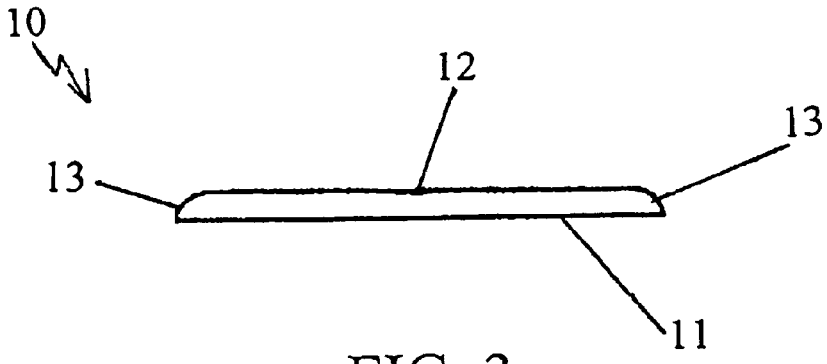
FIG. 3 shows a side plan view of the present invention. The smooth curve from the smaller bottom side to the larger top side is the key feature of this figure.

As shown in FIGS. 1, 2 and 3, a hydroplane or skim board 10 in accordance with the present invention is circular in shape. The top and bottom sides 11 12, respectively, of the skim board are flat (substantially planar). The top side 11 is preferably not tapered. The side rail 13 is smoothly curved from the smaller bottom side 12 to the larger top side 11. The smoothly curved, circular side rail 13 connects the bottom side 12 to the top side 11 of the skim board 10. This shaping reduces friction with the water and provides lifting action with forward motion of the board and thereby promotes hydroplaning. A central marking 14 on the top side 11 helps the user to properly mount the skim board 10. The prototype model of the present invention here described measures 33 ½ inches in diameter on the top side 31 ½ inches on the bottom side, and is ⅝ inches thick. The overall diameter of the invention should be adjusted to accommodate the size and ability of the user. The skim board of the present invention is not intended to be towed behind a boat or the like, so the skim board does not comprise a towing means, seating means, or steering means. FIGS. 1, 2, and 3 show the present invention in different views.

The prototype model of the present invention was manufactured out of ⅝ inch plywood, coated with enamel paint and several coats of marine quality varnish.

The prototype model of the present invention uses surfboard wax on the top surface to provide a high co-efficient of friction for the user. The bottom surface is preferably coated with multiple coats of marine varnish , or polyurethane, to provide a low co-efficient of friction. However, other materials and methods may also be utilized. The top side then, has a co-efficient of friction with the soles of the user's feet that is higher than a co-efficient of friction of the bottom side with the shore's surface and the thin layer of water between the bottom side of the board and the shore's surface.

A hydroplane board in accordance with the present invention is buoyant in water by itself. However, if a user were to stand upon it, it will be forced to the bottom. This property optimizes the hydroplane action.

A hydroplane board in accordance with the present invention is circular and has smoothly curved side rails from the smaller bottom side to the larger top side. This is a key property which optimizes the hydroplane action by minimizing the water friction against the board. These properties of the present invention also permit the user to spin the board in place against the forces of current or tide while awaiting optimal launch conditions. These properties of the present invention also permit the user to launch the board with their foot from within the water, and to dismount and remount the board repeatedly, without stopping or picking up the board. There are no other hydroplane boards or skimboards which currently use these properties or methods.

The present invention also includes a method of personal skim boarding (or hydroplaning) along an edge of a body of water, such as an ocean or lake shore. The method comprises the steps of:

(a) placing in the shallow water a skim board 10 that is circular in shape, and comprises a substantially planar bottom side 12 having a first diameter, a substantially planar top side 11 having a second diameter larger than the first diameter, and a smoothly cured, uniform side rail 13 between the bottom side and the top side;

(b) pushing the skim board 10 forward; and (c) walking jogging or running toward the skim board 10, and jumping onto it, Preferably, the method includes an initial step prior to step (a) of varnishing an outer surface of the bottom side with at least two coats of varnish. The top surface of the top side is preferably waxed periodically with surfer's wax. This method may further include spinning the skim board 10 (preferably with the user's foot) in the shallow water and holding the skim board in place in the water with centripetal force before pushing the skim board forward, preferably with the foot. A preferred method of personal skim boarding herein comprises the additional steps of:

(a) dismounting the skim board 10 when it slows;

(b) pushing and accelerating the skim board 10, preferably with one foot, in a direction opposite the dismount while dismounting the skim board; and (c) remounting the skim board 10. Furthermore, the skim board 10 may be dismounted and remounted repeatedly.

While the invention has been illustrated and describe as embodied in hydroplane board and method of hydroplaning, it is not intended to be limited to the details shown, since various modifications and structural changes may be made without departing in any way from the spirit of the present invention.

Without further analysis, the foregoing will so fully reveal the gist of the present invention that other can readily it or modify it, without departing from the spirit or essential characteristics of this invention. The present embodiments are therefore to be considered in all respects as illustrative and not restrictive, the scope of the invention being indicated by the appended claims rather than by the foregoing description, and all changes that come within the meaning and range of equivalence of the claims are therefore to be intended to be embraced therein.

What is claimed as new and desired to be protected by Letters Patent is set forth in the following claims:

1. A skim board for skimming along a surface at a water's edge, the skim board comprising;

(a) a substantially planar bottom side having a first diameter;

(b) a substantially planar top side having a second diameter that is larger than the first diameter; and (c) a smoothly curved circular side rail connecting the bottom side to the top side;

wherein the skim board is circular in shape, and has no defined front, rear, left, or right sides; and wherein the skim board does not comprise a means for towing it.

2. A skim board according to claim 1, wherein ¾ the bottom side has a co-efficient of friction with the surface and a layer of water over the surface that is lower than a co-efficient of friction between a user's feet and the top side and the second diameter is approximately 2 inches greater than the first diameter.

3. A board according to claim 2, wherein the bottom side of the board is coated with polyurethane.

4. A board according to claim 1, further comprising rubber strips attached to a top surface of the top side.

5. A skim board according to claim 2, wherein the overall perimeter of the board is sized based upon the size, weight, and experience of a user.

6. A skim board according to claim 1, further comprising a mark in a center of the top side of the board.

7. A skim board according to claim 1, wherein the skim board is made of a material which has a buoyancy such that the skim board floats by itself in water and the skim board sinks when a user stands on the skim board in still water.

8. A method of personal skim boarding along an edge of a body of water, the method comprising the steps of:

(a) placing the skim board on water along the water's edge, the skim board being circular in shape and comprising a substantially planar bottom side having a first diameter, a substantially planar top side having a second diameter larger than the first diameter, and a uniform, circular side rail shaped in a smooth curve from the bottom side to the top side;

(b) pushing the skim board forward; and (c) walking, jogging, or running toward the skim board, and jumping onto the skim board.

9. A method of personal skim boarding according to claim 8, further comprising spinning the board in place in the water, and then repeating steps (b) and (c).

10. A method of personal skim boarding according to claim 8, wherein the the skim board is dismounted and remounted repeatedly.

11. A method of personal skim boarding according to claim 8, further comprising the steps of:

(a) dismounting the skim board when it slows;

(b) pushing and accelerating the skim board in a direction opposite the dismount while dismounting the skim board; and (c) remounting the skim board.

12. A skim board according to claim 6, wherein the mark is a label or a decal.

13. A circular skim board for skimming along a water's edge, the skim board comprising:

(a) a planar bottom side having a first diameter;

(b) a planar top side having a second diameter that is larger than the first diameter; and (c) a smoothly curved, circular side rail extending around an edge of the skim board, the side rail joining the bottom side and the top side;

wherein the skim board does not comprise any seating means or steering means.

14. A skim board according to claim 13, wherein an average depth of the water layer along the water's edge is less than about ½ inch.

15. A skim board according to claim 13, wherein the water's edge is at a shore of a beach or lake.

16. A skim board according to claim 15, wherein the top side has a co-efficient of friction with a user's feet that is higher than a co-efficient of friction of the bottom side with a surface of the shore and a layer of water between the bottom side and the shore's surface.

17. A method of personal skim boarding according to claim 8, wherein an average depth of the water's edge is less than about ½ inch.

18. A method of personal skim boarding according to claim 8, further comprising an initial step prior to step (a) of varnishing an outer surface of the bottom side with at least two coats of varnish.

19. A method of personal skim boarding according to claim 9, further comprising a step of periodically waxing a top surface of the top side.

* * * * *